US009016534B2

(12) United States Patent
Whitley et al.

(10) Patent No.: US 9,016,534 B2
(45) Date of Patent: Apr. 28, 2015

(54) LAMINATE LANYARDS AND METHODS FOR MAKING THE SAME

(71) Applicant: Apple Inc., Cupertino, CA (US)

(72) Inventors: Crenshaw Whitley, San Francisco, CA (US); Craig Stanley, Santa Clara, CA (US); Matthew Rohrbach, San Francisco, CA (US); Trent Weber, San Francisco, CA (US); Robert Merrit, Sunnyvale, CA (US); Erik L. Wang, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 75 days.

(21) Appl. No.: 13/631,269

(22) Filed: Sep. 28, 2012

(65) Prior Publication Data

US 2014/0001216 A1 Jan. 2, 2014

Related U.S. Application Data

(60) Provisional application No. 61/665,108, filed on Jun. 27, 2012.

(51) Int. Cl.
*A45F 5/00* (2006.01)

(52) U.S. Cl.
CPC ..... *A45F 5/00* (2013.01); *Y10T 156/1043* (2015.01); *Y10T 156/10* (2015.01); *A45F 2005/006* (2013.01)

(58) Field of Classification Search
CPC A45F 5/00; A45F 2005/006; A45F 2005/008
USPC ..... 224/254–258, 600, 602, 219, 222; 428/36.1–36.4
See application file for complete search history.

(56) References Cited

U.S. PATENT DOCUMENTS

| | | | | |
|---|---|---|---|---|
| 4,937,920 | A * | 7/1990 | Tsai | 24/3.3 |
| 5,190,802 | A | 3/1993 | Pilato | |
| 6,503,855 | B1 * | 1/2003 | Menzies et al. | 442/328 |
| 2004/0094592 | A1 * | 5/2004 | Brown | 224/623 |

FOREIGN PATENT DOCUMENTS

| | | |
|---|---|---|
| GB | 2300833 | 11/1996 |
| TW | 386942 | 4/2000 |
| TW | 412952 | 11/2000 |
| WO | WO01/94108 | 12/2001 |

OTHER PUBLICATIONS

International Search Report, PCT Application No. PCT/US2013/045934, 3 pages, Oct. 1, 2013.

* cited by examiner

*Primary Examiner* — Adam Waggenspack
(74) *Attorney, Agent, or Firm* — Brownstein Hyatt Farber Schreck, LLP

(57) ABSTRACT

Laminate lanyards and methods for making the same are disclosed. The laminate lanyards may include a head formed from a reinforcing loop of yarn incorporated within a scrim. The head can be coupled to the head section of a body, which also includes a main section that forms the loop of the laminate lanyard. A gusset can be coupled to ends of the main section of the body to couple the two ends of the body together and facilitate opening and closing of the loop of the laminate lanyard. A slider may also be included in laminate lanyard for adjusting the size of the loop.

21 Claims, 5 Drawing Sheets

LAMINATE LANYARDS AND METHODS FOR MAKING THE SAME

CROSS-REFERENCE TO RELATED APPLICATION

This application claims the benefit of U.S. Provisional Application No. 61/665,108, filed Jun. 27, 2012, the disclosure of which is incorporated by reference herein in its entirety.

BACKGROUND

Lanyards are commonly used for holding small personal effects such as keys, access badges, and small electronic devices. Lanyards may include a loop of material that is meant to be worn around a person's neck or wrist and a mechanism for connecting the lanyard to an object.

SUMMARY

Laminate lanyards and methods for making the same are disclosed. Laminate lanyards can include a body section, which can form a loop, and a head section with an opening for attaching the laminate lanyard to an object. The body and head of the laminate lanyard may include several layers of material coupled together along with one or more adhesive layers. Additionally, a fiber loop may be incorporated around the opening and within the head to provide reinforcement for the head and opening, as those portions of the laminate lanyard may be subject to various stresses during normal use. A gusset can be included to facilitate coupling of the body portion of the laminate lanyard to the head portion. In some embodiments, a slider may be provided for adjusting the dimensions of the loop created by the body section of the laminate lanyard.

BRIEF DESCRIPTION OF THE DRAWINGS

The above and other aspects of the invention, its nature, and various features will become more apparent upon consideration of the following detailed description, taken in conjunction with the accompanying drawings, in which like reference characters may refer to like parts throughout, and in which.

DETAILED DESCRIPTION

Figure 1:
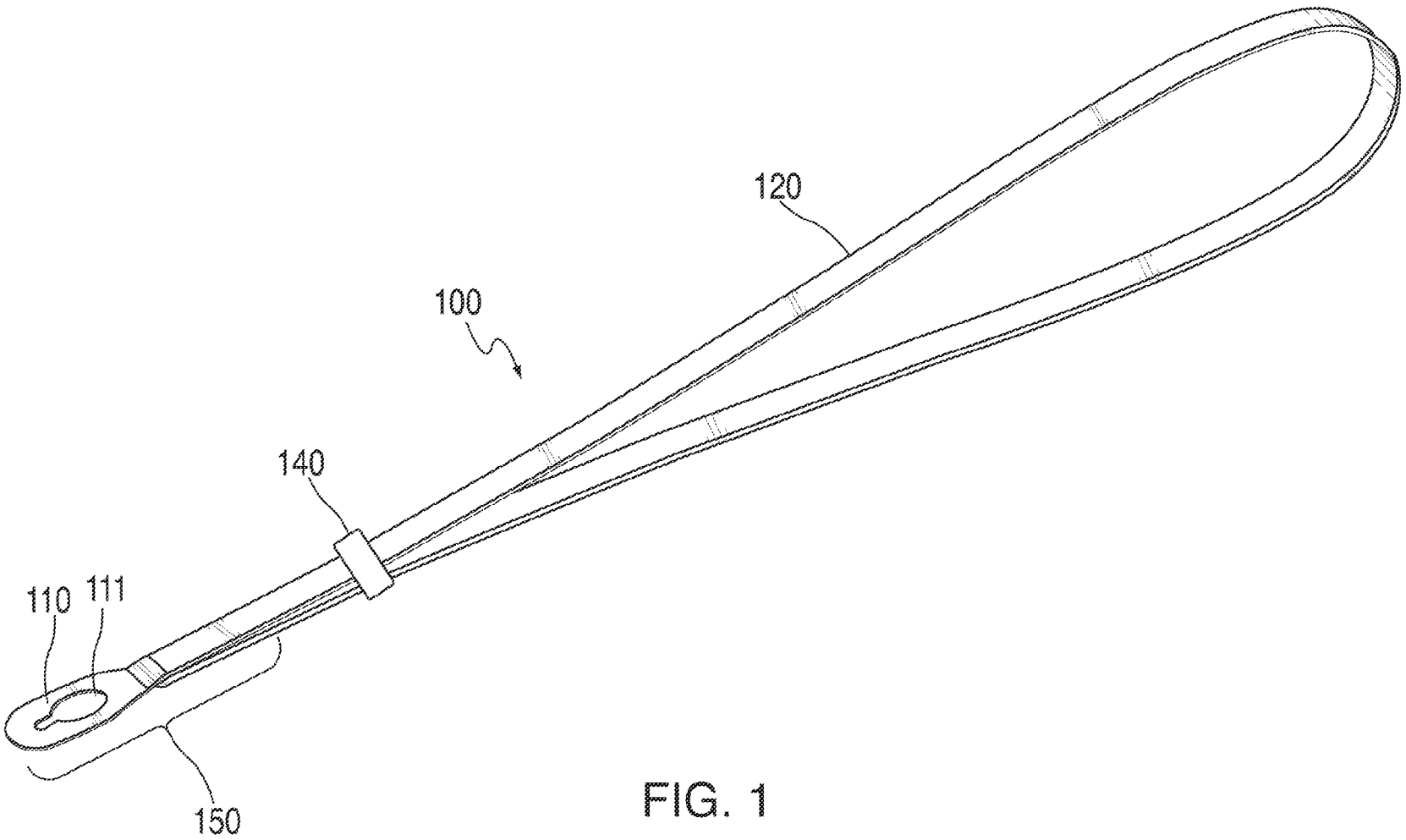
FIG. 1 shows a perspective view of a laminate lanyard in accordance with various embodiments.

FIG. 1 shows a perspective view of a laminate lanyard 100 in accordance with various embodiments. Laminate lanyard 100 can include body 120, head 110, and slider 140. Head 110 may include opening 111 for attaching laminate lanyard 100 to an object, and body 120 may be coupled to head 110 at transition region 150.

Body 120 can include a number of layers of material (e.g., polyurethanes, microfibers, and woven fabric), which can be pressed and held together with one or more layers of adhesive. In some embodiments, body 120 may be assembled as one long, flat strip and then folded over and coupled to head 110 at transition region 150 to form the loop of laminate lanyard 100. Body 120 may include a head section at either end of a main section. According to some embodiments, the head sections can be integrally formed with body 120 and have the same dimensions as head 110. The head sections of body 120 may only include a single layer of material (e.g., a woven fabric).

Head 110 may include a number of material layers, which may be different from the layers of material that are included in body 120. Head 110 can also include a loop of high-strength fiber for reinforcing the thin areas surrounding opening 111. In some embodiments, the fiber may be a liquid-crystal fiber such as Vectran®. In other embodiments, any suitable fiber, including Kevlar (or other aramid or para-aramid fibers), xylow, nitinol, steel, or other natural, synthetic, and/or metallic fibers may be used in addition to, or as an alternative to, Vectran®. According to some embodiments, head 110 may be stamped or cut out from a scrim sheet for incorporation into laminate lanyard 100. Scrim sheets will be discussed in more detail below with respect to FIGS. 3 and 4.

Head 110 may be coupled to body 120 within transition region 150. Transition region 150 can include one or more layers of body 120 overlapping at least a portion of head 110. For example, head 110 may include a transition section that is pressed between end portions of the main section of body 120. Additionally, a gusset can be incorporated into laminate lanyard 100 to reinforce transition region 150 and to provide a hinge that facilitates opening and closing of the loop of laminate lanyard 100. The gusset may be incorporated into transition region 150 very close to, or abutting, the end of the transition section of head 110.

Slider 140 may be any ring-shaped object configured to slide up and down body 120 while providing enough friction so as to be suitable for adjusting the size of the loop of laminated lanyard 100.

Figure 2:
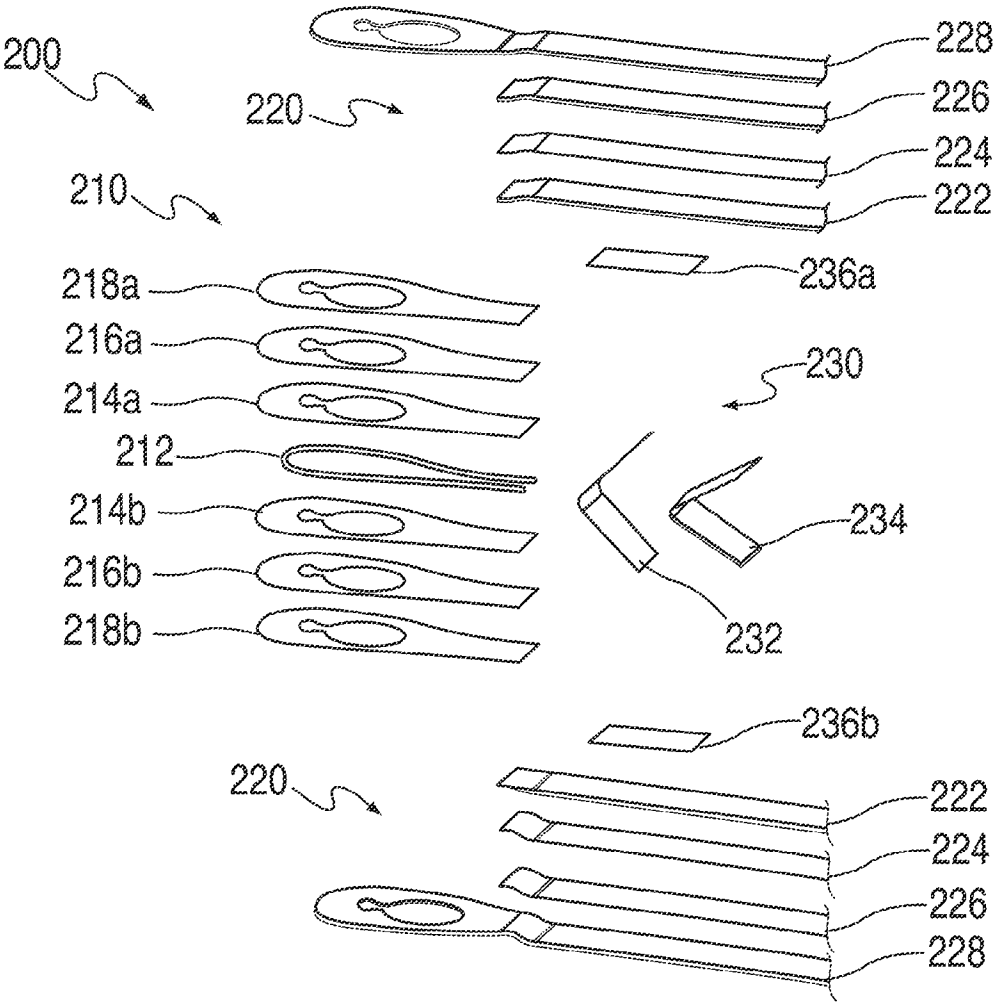
FIG. 2 shows an exploded view of the junction between a head section and a body section of a laminate lanyard in accordance with various embodiments.

FIG. 2 shows an exploded view of a portion of laminate lanyard 200 in accordance with various embodiments. Laminate lanyard 200 may correspond to, for example, the portion of laminate lanyard 100 of FIG. 1 including head 110, transition region 150, and the proximate portions of the main section of body 120. Laminate lanyard 200 may include head 210, body 220, and gusset 230.

Head 210 can be assembled by stacking and coupling together a number of individual material layers on either side of a loop of fiber 214. In an exemplary embodiment, fiber 214 can be an untwisted Vectran® yarn, which exhibits high strength and low elasticity. However, any suitable fiber may be used to reinforce head 210, including Kevlar (or other aramid or para-aramid fibers), xylow, nitinol, steel, or other natural, synthetic, and/or metallic fibers, or combinations of the above fibers.

The material layers of head 210 may include inner scrim adhesive layers 214*a* and 214*b*, scrim layers 216*a* and 216*b*, and outer scrim adhesive layers 218*a* and 218*b*. Inner scrim adhesive layers 214*a* and 214*b* can be any suitable material that promotes adhesion between fiber 212 and scrim layers 216*a*. According to some embodiments, inner scrim adhesive layers 214*a* and 214*b* can include a thermoplastic adhesive. In other embodiments, however, any suitable adhesive, such as an epoxy or glue may be used.

Scrim layers 216*a* and 216*b* may, along with fiber 212, provide reinforcement for head 210 of laminate lanyard 200.

Thus, a relatively strong material, such as polyethylene terephthalate ("PET") may be incorporated into scrim layers 216*a* and 216*b*. According to some other embodiments, scrim layers 216*a* and 216*b* may include other strong materials, including woven fabrics (e.g., Vectran® fabrics), polymers, and/or metals (e.g., aluminum, titanium, or steel).

Outer scrim adhesive layers 218*a* and 218*b* can be any suitable material that promotes adhesion between scrim layers 216*a* and outer cover layer 228 of body 220. According to some embodiments, outer scrim adhesive layers 218*a* and 218*b* can include a thermoplastic adhesive (e.g., the same or a different thermoplastic adhesive used in inner scrim adhesive layers 214*a* and 214*b*). In other embodiments, however, any suitable adhesive, such as an epoxy or glue may be used.

Body 220, like head 210, can also be assembled by stacking and coupling together a number of individual material layers. According to some embodiments, body 220 can include an inner cover layer 222, inner adhesive layer 224, outer adhesive layer 226, and outer cover layer 228.

Outer cover layer 228 can form one of the outer surfaces of laminate lanyard 200, so it may be beneficial to choose a material that is visually and/or tactilely appealing. In some embodiments, outer cover layer 228 may be a woven fabric. For example, outer cover layer 228 may be woven from Vectran®, or any other suitable yarn. In embodiments employing Vectran®, the inner surface of outer cover layer 228 may further be pre-coated with an outer adhesive layer 226 (e.g., a cross-linking polyurethane) to promote adhesion between outer cover layer 228 and inner adhesive layer 224.

Inner adhesive layer 224 can be any suitable material that promotes adhesion between outer cover layer 228 and inner cover layer 222. According to some embodiments, inner adhesive layer 224 can include a thermoplastic adhesive. In other embodiments, however, any suitable adhesive, such as an epoxy or glue may be used.

Inner cover layer 222 can form an outer surface of laminate lanyard 200 opposing outer cover layer 228. According to some embodiments, inner cover layer 222 can be a microfiber material. However, in other embodiments, inner cover layer 222 may include any visually and/or tactilely appealing material such as a woven fabric or felt.

According to some embodiments, a gusset 230 may be incorporated into laminate lanyard 200 between portions of the ends of the main section of body 220. Because head 210 may be preassembled before being incorporated into laminate lanyard 200, layers of head 210 may not overlap any portion of gusset 230. Rather, gusset 230 may be placed between portions of body 220 close to or abutting head 210. Gusset 230 may be a bent or hinged member that can hold the ends of body 220 together and provide a mechanism for opening and closing the loop of laminate lanyard 200.

Gusset 230 may be formed from a base layer 234 and an adhesive layer 232. Additionally, gusset 230 can be coupled to body 220 with adhesive members 236*a* and 236*b*. Base layer 244 may include a flexible, strong material that couples together the two ends of body 220 and facilitates opening and closing of the loop of laminate lanyard 200. According to some embodiments, base layer 234 can be a woven fabric (e.g., a fabric woven from a material such as Vectran® yarn). In those embodiments, base layer 234 may be pre-coated with an adhesive layer 232 (e.g., a cross-linking polyurethane) to promote adhesion between base layer 234 and adhesive members 236*a* and 236*b*.

Adhesive members 236*a* and 236*b* can be any suitable material that promotes adhesion between base layer 234 and/or adhesive layer 232 and inner cover layer 222 of body 220. According to some embodiments, adhesive members 236*a* and 236*b* can include a thermoplastic adhesive. In other embodiments, however, any suitable adhesive, such as an epoxy or glue may be used.

Figure 3:
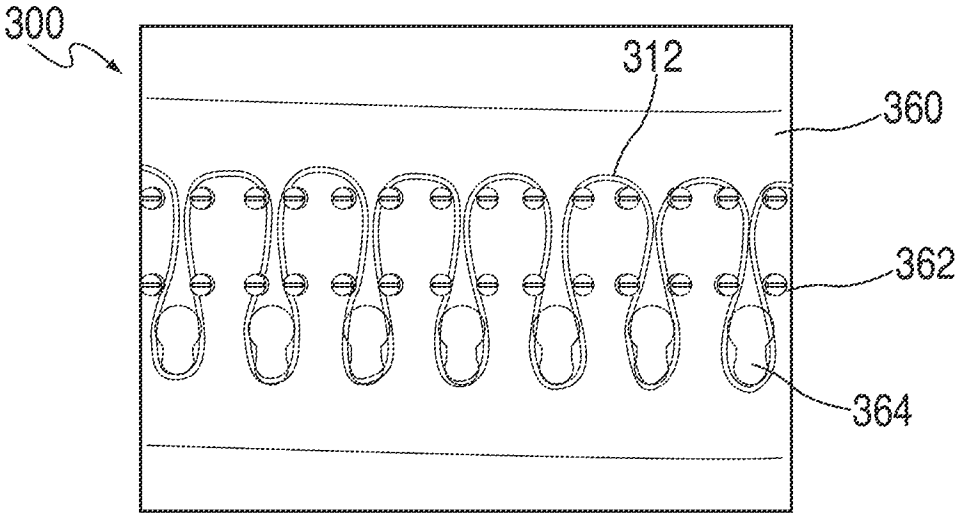
FIG. 3 shows a top view of a portion of a mechanism for forming a scrim sheet including loops of fiber in accordance with various embodiments.

FIG. 3 shows a top view of a portion of a mechanism 300 for forming a scrim sheet including loops of fiber 312 in accordance with various embodiments. Mechanism 300 may include a working surface 360, alignment posts 362, and head posts 364. Alignment posts 362 and head posts 364 may be spring loaded, such that the posts can be compressed to the level of working surface 360 under applied pressure.

A length of fiber 312 (e.g., Vectran® fiber) may be threaded through alignment posts 362 and head posts 364 with sufficient tension to suspend fiber 312 above working surface 360. Material layers can be laid under and over fiber 312 and pressed to form a scrim sheet. For example, a first set of material layers (e.g., layers 214*a*, 216*a*, and 218*a* of FIG. 2) can be placed on working surface 360 prior to fiber 312 being threaded through alignment posts 362 and head posts 364. Similarly, a second set of material layers (e.g., layers 214*b*, 216*b*, and 218*b* of FIG. 2) can be placed upon the threaded fiber. Once the material layers are in place, pressure and/or heat may be applied to working surface 360 of mechanism 300 to couple together the material layers and fiber 312. Accordingly, when the material layers are pressed together, fiber 312 can be fully encased within the material layers, thus forming the full scrim sheet.

Alignment holes can be precut in the material layers for properly aligning the material layers in mechanism 300. Proper alignment of the material layers may be beneficial if, for example, any of the material layers have anisotropic strength and/or elasticity properties. In this manner, the scrim sheets produced by mechanism 300 in each run can be consistently strong in the critical directions.

In some embodiments, the material layers may be heated in order to promote adhesion between the layers. In some embodiments, heat may be applied by elements included within mechanism 300 (e.g., by heating elements that elevate the temperature of working surface 360). In other embodiments, heat can be introduced from an external source (e.g., a heat plate used to apply pressure to the material layers and working surface 360 or an oven in which mechanism 300 is placed).

Figure 4:
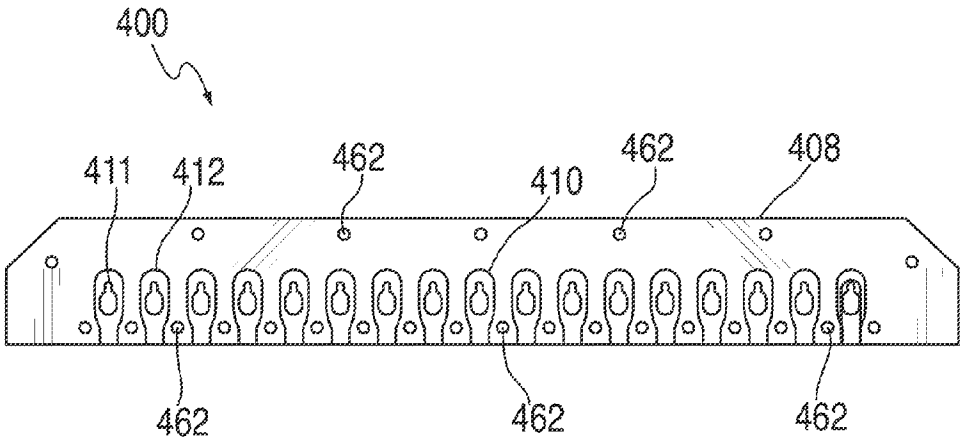
FIG. 4 shows a top plan view of a scrim sheet in accordance with various embodiments.

FIG. 4 shows a top plan view of a scrim sheet 400 in accordance with various embodiments. Scrim sheet 400 can include scrim 408, which may include several material layers coupled together with pressure and/or heat, and fiber 412. Scrim sheet 400 can include alignment holes 462, which can correspond to alignment posts 362 of mechanism 300 as depicted in FIG. 3. Alignment holes 462 can, along with alignment posts 362, ensure that identical scrim sheets 400 are produced over any suitable number of runs.

Individual heads 410 can be separated from scrim sheet 400 using any suitable method (e.g., sawing, die cutting, or stamping). Additionally, openings 411 can be provided for each head 410. In some embodiments, openings 411 may be formed at the same time as heads 410 are separated from scrim sheet 400 (e.g., in the same die-cutting process). In other embodiments, openings 411 may be formed before or after heads 410 are separated from scrim sheet 400.

Figure 5:
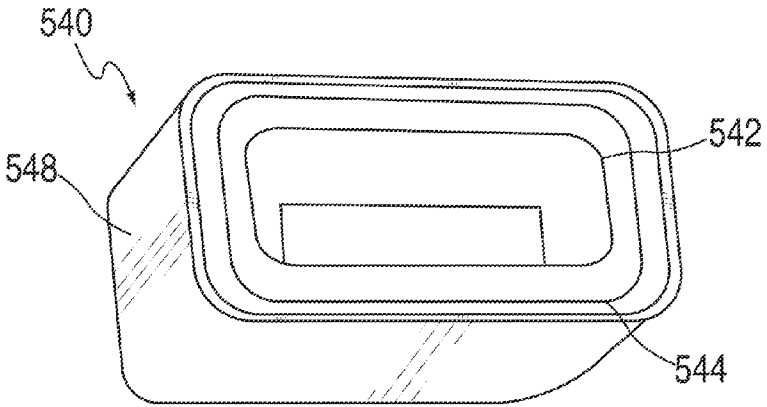
FIG. 5 shows a perspective view of slider in accordance with various embodiments.

FIG. 5 shows a perspective view of slider 540 in accordance with various embodiments. Slider 540 may include outer cover layer 548, inner cover layer 542, and adhesive layer 544. In some embodiments, outer cover layer 548 may include the same material(s) as outer cover layer 228 of FIG. 2. Thus, in some embodiments, outer cover layer 548 may be a woven fabric (e.g., a fabric woven from Vectran® yarn).

In some embodiments, inner cover layer 542 may be formed from the same material(s) as inner cover layer 222 of FIG. 2. Thus, inner cover layer 542 may be, for example, a microfiber material. Adhesive layer 544 can be any suitable material that promotes adhesion between outer cover layer 548 and inner cover layer 542 of slider 540. According to some embodiments, adhesive layer 544 can include a thermoplastic adhesive. In other embodiments, in which outer cover layer 548 is a woven fabric incorporating Vectran® yarn, outer cover layer 548 can be pre-coated with an additional adhesive layer (e.g., a cross-linking polyurethane). In some embodiments, slider 540 may be cut from a long roll of the outer cover layer/adhesive layer/inner cover layer stack.

Figure 6:
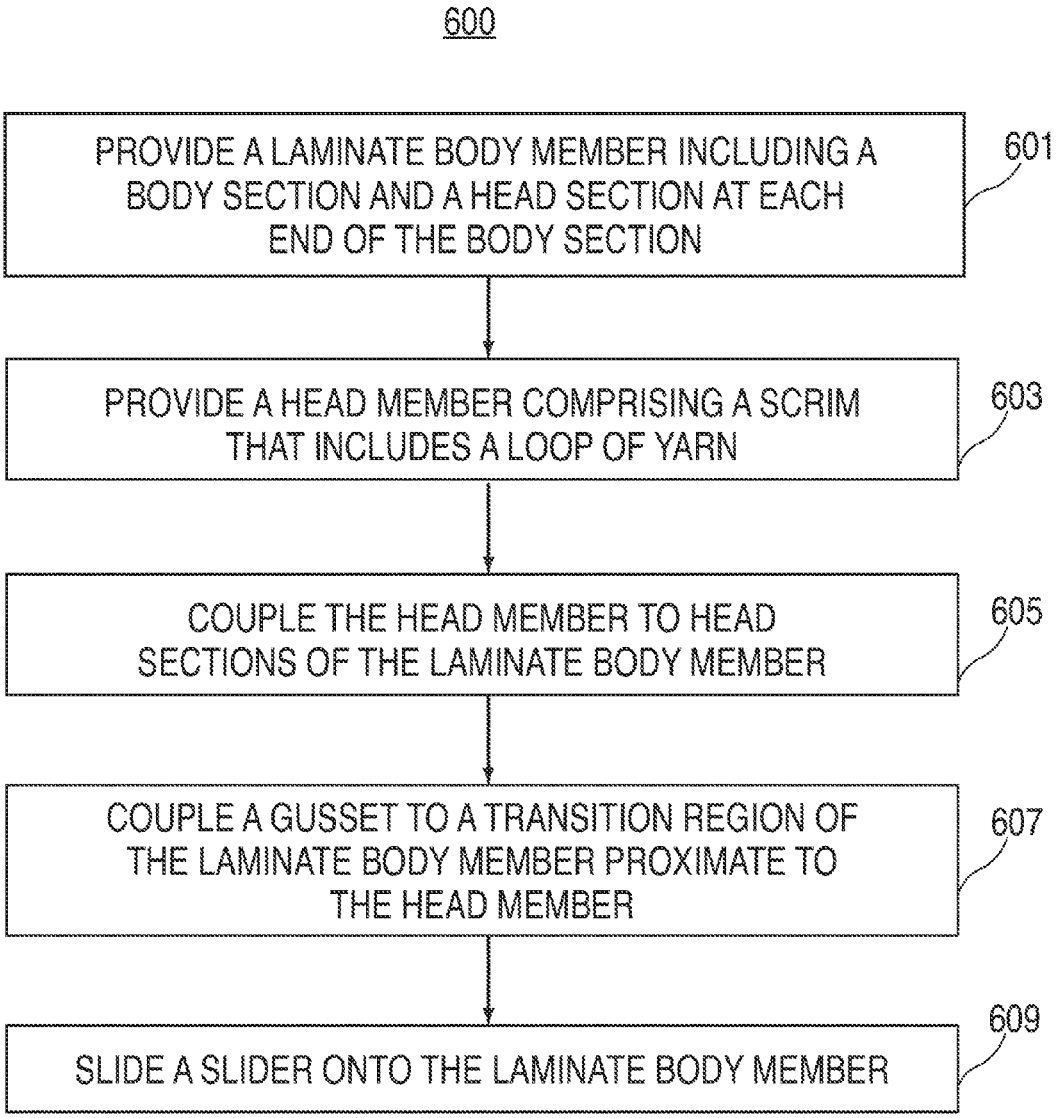
FIG. 6 is a flowchart of an illustrative process for forming a laminate lanyard in accordance with various embodiments.

FIG. 6 is a flowchart of an illustrative process 600 for forming a laminate lanyard in accordance with various embodiments. At step 601, a laminate body member can be provided. The laminate body member can be a laminate structure formed from several layers. For example, the laminate body member may be body 220 of FIG. 2, which includes an inner cover layer 222, inner adhesive layer 224, and outer cover layer 228. According to embodiments in which the outer cover layer is formed from Vectran®, the laminate body member may be further pre-coated with an outer adhesive layer (e.g., outer adhesive layer 226 of FIG. 2). The various layers of the laminate body member may be coupled together using conventional adhesives, and/or the application of pressure and/or heat.

At step 603, a head member can be provided. The head member may include a scrim that includes a loop of yarn. For example the head member may be similar to head 210 of FIG. 2, which includes fiber loop 212, inner scrim adhesive layers 214*a* and 214*b*, scrim layers 216*a* and 216*b*, and outer scrim adhesive layers 218*a* and 218*b*. The adhesive layers may include a thermoplastic adhesive, epoxy, glue, and/or any other suitable adhesive. The various layers of the laminate body member may be coupled together using the adhesives, and/or the application of pressure and/or heat. A hole can be formed within the area defined by the fiber loop to facilitate coupling the laminate lanyard to an object.

According to some embodiments, the head member can be fabricated by placing a first material stack, including an inner scrim adhesive layer, a scrim layer, and an outer scrim adhesive layer, upon a mechanism that includes head posts and alignment posts (e.g., head posts 364 and alignment posts 362 of FIG. 3). The layers of the material stack can include alignment holes (e.g., alignment holes 462 of FIG. 4) corresponding to the alignment posts such that the material stack can be placed on a working surface of the mechanism (e.g., working surface 360 of FIG. 3). The alignment posts can engage the alignment holes to restrict lateral movement of the material stack with respect to the working surface.

A length of fiber (e.g., length of fiber 312) can be threaded through the alignment posts and head posts with sufficient tension to suspend it above the working surface and the first material stack. The length of fiber may be threaded manually or automatically (e.g., with the aid of a threading machine).

A second material stack can be layered above the length of fiber. The second material stack may be substantially identical to the first material stack. Accordingly the second material stack can include an inner scrim adhesive layer, a scrim layer, an outer scrim adhesive layer, and alignment holes. The first and second material stacks and the length of fiber can then be coupled together by being pressed together and/or being exposed to heat. According to some embodiments, the alignment posts and the head posts can be spring loaded such that they can be compressed to the level of the working surface with applied pressure (e.g., the pressure applied to couple together the first and second material stacks and the length of fiber).

At step 605, the head member can be coupled to head sections of the laminate body member. The head member may be coupled to the head sections of the laminate body member using adhesive layers (e.g., outer scrim adhesive layers 218*a* and 218*b*). The outer scrim adhesive layers may be formed from any suitable adhesive, including a thermoplastic adhesive, an epoxy, and/or a glue. In embodiments in which the head sections of the laminate body member are formed from Vectran®, a layer of a cross-linking polyurethane may be included between the laminate body member and the outer scrim adhesive layers.

At step 607, a gusset can be coupled to a transition region of the laminate body proximate to the head member. The gusset may be similar to gusset 230 of FIG. 2, which includes a base layer 234 and an adhesive layer 232. The gusset may be bent into a V-shape such that the point, or hinge, of the gusset is close to or abuts the head. The surfaces of the gusset that extend away from the hinge can be coupled to the laminate body with the adhesive layer or with additional adhesive members (e.g., adhesive members 236*a* and 236*b* of FIG. 2).

At step 609, a slider can be slid onto the laminate body member. The slider can be a ring-shaped object that can slide up and down the length of the laminate body member. For example, the slider may be similar to slider 540 of FIG. 5, which includes an outer cover layer 548, an adhesive layer 544, and an inner cover layer 542. In some embodiments, the slider can be cut from a long roll of the outer cover layer, adhesive layer, inner cover layer stack.

It should be understood that the processes described above are merely illustrative. Any of the steps may be removed, modified, or combined, and any additional steps may be added or steps may be performed in different orders, without departing from the scope of the invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A laminate lanyard comprising:

a head comprising a scrim and a loop of yarn, wherein the loop of yarn is incorporated within the scrim, and wherein an opening is formed in the scrim inside the loop of yarn;

a body for hanging the lanyard around a first object, comprising a main section and two head sections, wherein the head is coupled between the two head sections of the body; and the two head sections of the body overlap at least a portion of the scrim and loop of yarn, and have openings aligned with the opening in the yarn such that the lanyard has an opening for attaching the lanyard to one of the first object and a second object.

2. The laminate lanyard of claim 1, wherein the loop of yarn comprises untwisted melt spun liquid crystal polymer yarn.

3. The laminate lanyard of claim 1, wherein the loop of yarn comprises at least one of aram id fibers, xylow, nitinol, and steel.

4. The laminate lanyard of claim 1, wherein the scrim is a laminate member comprising:

the loop of yarn;

at least two inner scrim adhesive layers, wherein an inner scrim adhesive layer is layered on each side of the loop of yarn; at least two reinforcement scrim layers, wherein a reinforcement scrim layer is layered on each of the at least two inner scrim adhesive layers;

at least two outer scrim adhesive layers, wherein an outer scrim adhesive layer is layered on each of the at least two reinforcement scrim layers.

5. The laminate lanyard of claim 4, wherein the two head sections of the body are coupled to the at least two outer scrim adhesive layers of the head.

6. The laminate lanyard of claim 4, wherein the body comprises melt spun liquid crystal polymer.

7. The laminate lanyard of claim 6, further comprising a cross-linking polyurethane coated on the two head sections of the body to promote adhesion to the at least two outer scrim adhesive layers of the head.

8. The laminate lanyard of claim 4, wherein the at least two outer scrim adhesive layers and the at least two inner scrim adhesive layers comprise at least one of a thermoplastic adhesive, an epoxy, and a glue.

9. The laminate lanyard of claim 1, further comprising a slider configured to alter dimensions of the loop of yarn.

10. The laminate lanyard of claim 9, wherein the slider is ring shaped.

11. The laminate lanyard of claim 9, wherein the slider alters the dimensions of the loop of yarn by applying a retaining friction to the loop of yarn.

12. The laminate lanyard of claim 1, further comprising a slider coupled to the main section of the body and configured to slide up and down the main section.

13. A lanyard comprising:

a body member comprising a body section for hanging the lanyard around an oject, two head sections, and an inner surface;

a head member coupled to the inner surface of the two head sections of the body member, the head member comprising a fiber loop incorporated within a laminate scrim member; and a V-shaped gusset coupled to the inner surface of the body section of the body member, wherein a point of the V-shaped gusset is disposed proximate to the head member.

14. The lanyard of claim 13, wherein the body member comprises an inner cover layer coupled to an outer cover layer with an adhesive layer, wherein an outer surface of the inner cover layer forms at least part of the inner surface of the body member.

15. The lanyard of claim 14, wherein the two head sections of the body member comprise one layer formed from the outer cover layer, and wherein the outer cover layer forms at least part of the inner surface of the body member.

16. The lanyard of claim 13, wherein the V-shaped gusset forms a hinge for opening and closing a loop of the lanyard formed by the body section of the body member.

17. The lanyard of claim 16, further comprising a slider configured to alter dimensions of the loop.

18. The laminate lanyard of claim 17, wherein the slider is ring shaped.

19. The laminate lanyard of claim 17, wherein the slider alters the dimensions of the loop of yarn by applying a retaining friction to the loop of yarn.

20. The lanyard of claim 13, further comprising a slider coupled to the body section of the body member configured to slide up and down the body section.

21. The laminate lanyard of claim 13, further comprising a slider comprising:

an outer cover layer;

an inner cover layer; and an adhesive layer disposed between the outer cover layer and the inner cover layer.

* * * * *